US011083347B2

(12) United States Patent
Hahn

(10) Patent No.: US 11,083,347 B2
(45) Date of Patent: Aug. 10, 2021

(54) REVERSIBLE TOILET PAPER ROLL HOLDER

(71) Applicant: Andrew Hahn, Moses Lake, WA (US)

(72) Inventor: Andrew Hahn, Moses Lake, WA (US)

( * ) Notice: Subject to any disclaimer, the term of this patent is extended or adjusted under 35 U.S.C. 154(b) by 0 days.

(21) Appl. No.: 16/999,342

(22) Filed: Aug. 21, 2020

(65) Prior Publication Data

US 2021/0177216 A1 Jun. 17, 2021

Related U.S. Application Data

(60) Provisional application No. 62/947,594, filed on Dec. 13, 2019.

(51) Int. Cl.
*A47K 10/22* (2006.01)
*A47K 10/18* (2006.01)

(52) U.S. Cl.
CPC ..... *A47K 10/22* (2013.01); *A47K 10/18* (2013.01)

(58) Field of Classification Search
CPC ..... A47K 10/22; A47K 10/18; A47K 10/00
USPC ..... 242/598
See application file for complete search history.

(56) References Cited

U.S. PATENT DOCUMENTS 1,687,819 A 10/1928 Worthington
2,493,893 A * 1/1950 Miller ..... A47K 10/22 242/597.4
4,270,706 A 6/1981 Robinson
5,222,678 A * 6/1993 Carrington ..... A47K 10/40 242/598.2
5,450,981 A * 9/1995 Fields ..... A47K 10/3836 221/33
5,588,615 A 12/1996 Batts
5,718,396 A * 2/1998 Maresca ..... A47K 10/38 242/598.2
5,782,428 A * 7/1998 Chabot ..... A47K 10/38 242/596.3
7,306,185 B1 12/2007 Miller
7,740,154 B2 * 6/2010 Kennedy ..... B05B 11/3052 222/205
10,398,263 B2 9/2019 Goodman et al.
(Continued)

FOREIGN PATENT DOCUMENTS

CA 2731125 A1 * 8/2012 ..... A47K 10/3643
FR 2732579 A1 * 10/1996 ..... A47K 10/22
(Continued)

*Primary Examiner* — Stephen M Gravini
(74) *Attorney, Agent, or Firm* — Boudwin Intellectual Property; Daniel Boudwin

(57) ABSTRACT

A reversible toilet paper roll holder. The reversible toilet paper roll holder has a base with an arm extending through the base. The arm is rotatably secured to a locking notch that enables a user to lock the device in a pair of orientations. A horizontal support is connected to a distal end of the arm, and a pair of lateral supports are each connected to the horizontal support. In one embodiment, a pair of lateral supports can secure a toilet paper roll therebetween, while in other embodiments, the pair of lateral supports can secure a compressible rod therebetween. The compressible rod can be threaded through a central bore of a roll of toilet paper. The orientation of the arm can be rotated to reverse the direction at which toilet paper is dispensed by rotating the toilet paper roll without removing the toilet paper roll from the device.

20 Claims, 4 Drawing Sheets

(56) References Cited

U.S. PATENT DOCUMENTS

| | | | | |
|---|---|---|---|---|
| 10,582,812 | B2 * | 3/2020 | Goodman | A47K 10/3836 |
| 2018/0229962 | A1 * | 8/2018 | Fahid | A47K 10/40 |
| 2019/0014956 | A1 * | 1/2019 | Chang | A47K 10/38 |
| 2019/0298118 | A1 * | 10/2019 | Goodman | A47K 10/3836 |
| 2020/0297170 | A1 * | 9/2020 | Regalado Cano | A47K 10/3836 |
| 2020/0390294 | A1 * | 12/2020 | Abuharthieh | A47K 10/38 |

FOREIGN PATENT DOCUMENTS

| | | | | |
|---|---|---|---|---|
| GB | 2355251 | A * | 4/2001 | A47K 10/22 |
| WO | WO-2018058180 | A1 * | 4/2018 | B65D 83/08 |

* cited by examiner

REVERSIBLE TOILET PAPER ROLL HOLDER

CROSS REFERENCE TO RELATED APPLICATIONS

This application claims the benefit of U.S. Provisional Application No. 62/947,594 filed on Dec. 13, 2019. The above identified patent application is herein incorporated by reference in its entirety to provide continuity of disclosure.

BACKGROUND OF THE INVENTION

The present invention relates to toilet paper holders. More particularly, the present invention provides for a reversible toilet paper roll holder which can be utilized to change the direction at which toilet paper is dispensed by altering the orientation of the toilet paper roll without removing the same from the device.

Many people disagree about the direction from which toilet paper and other similar products should be dispensed from a roll. Some people are steadfast that the proper orientation is for the paper to be wrapped and dispensed over-the-top to prevent the paper from contacting a surface such as a wall. Some argue that the paper is typically manufactured with a pattern present, which would not be visible if wrapped and dispensed in the opposing underneath fashion. Arguments are also made that to dispense the paper underneath, the user would need to stretch and lean farther to grasp the paper. On the other side of the argument, some people point out that if the roll were to be pulled upon by a pet or an infant, excessive amounts of paper would be dispensed. Further arguments and theories are advanced on both sides by countless people. Some people suggest that removing the roll from the dispenser and changing the orientation thereof to suit the user's desires eliminates the argument. However, some toilet paper dispensers, such as in public spaces, are locked and do not allow the user to remove the entire roll to change the orientation.

Devices have been disclosed in the known art that relate to toilet paper dispensers. These include devices that have been patented and disclosed in patent application publications. However, the devices in the known art have several drawbacks. Typical toilet paper dispenser devices are static and necessitate that the user make a choice in the orientation that the paper is dispensed in. Some dispensers enable a user to rotate the entire dispenser, but such devices typically require excessive space in which to rotate and operate. Some devices include removable parts which does not solve the issue of a locked or controlled dispenser as can be found in the public domain.

The present invention substantially diverges in design elements from the known art and consequently it is clear that there is a need in the art for an improvement to existing toilet paper roll dispensing devices. In this regard the present invention substantially fulfills these needs.

SUMMARY OF THE INVENTION

In view of the foregoing disadvantages inherent in the known types of toilet paper dispensers now present in the prior art, the present invention provides a reversible toilet paper roll holder wherein the same can be utilized to change the direction at which toilet paper is dispensed by altering the orientation of the toilet paper roll without removing the same from the device. The present reversible toilet paper roll holder comprises a base with an arm extending through the base. The arm is rotatably secured to a locking notch that enables a user to lock the device in a pair of orientations. A horizontal support is connected to a distal end of the arm, and a pair of lateral supports are each connected to the horizontal support. In one embodiment, a pair of lateral supports can secure a toilet paper roll therebetween, while in other embodiments, the pair of lateral supports can secure a compressible rod therebetween. The compressible rod can be threaded through a central bore of a roll of toilet paper. The arm can be rotated to reverse the direction at which toilet paper is dispensed by rotating the toilet paper roll without removing the toilet paper roll from the device.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
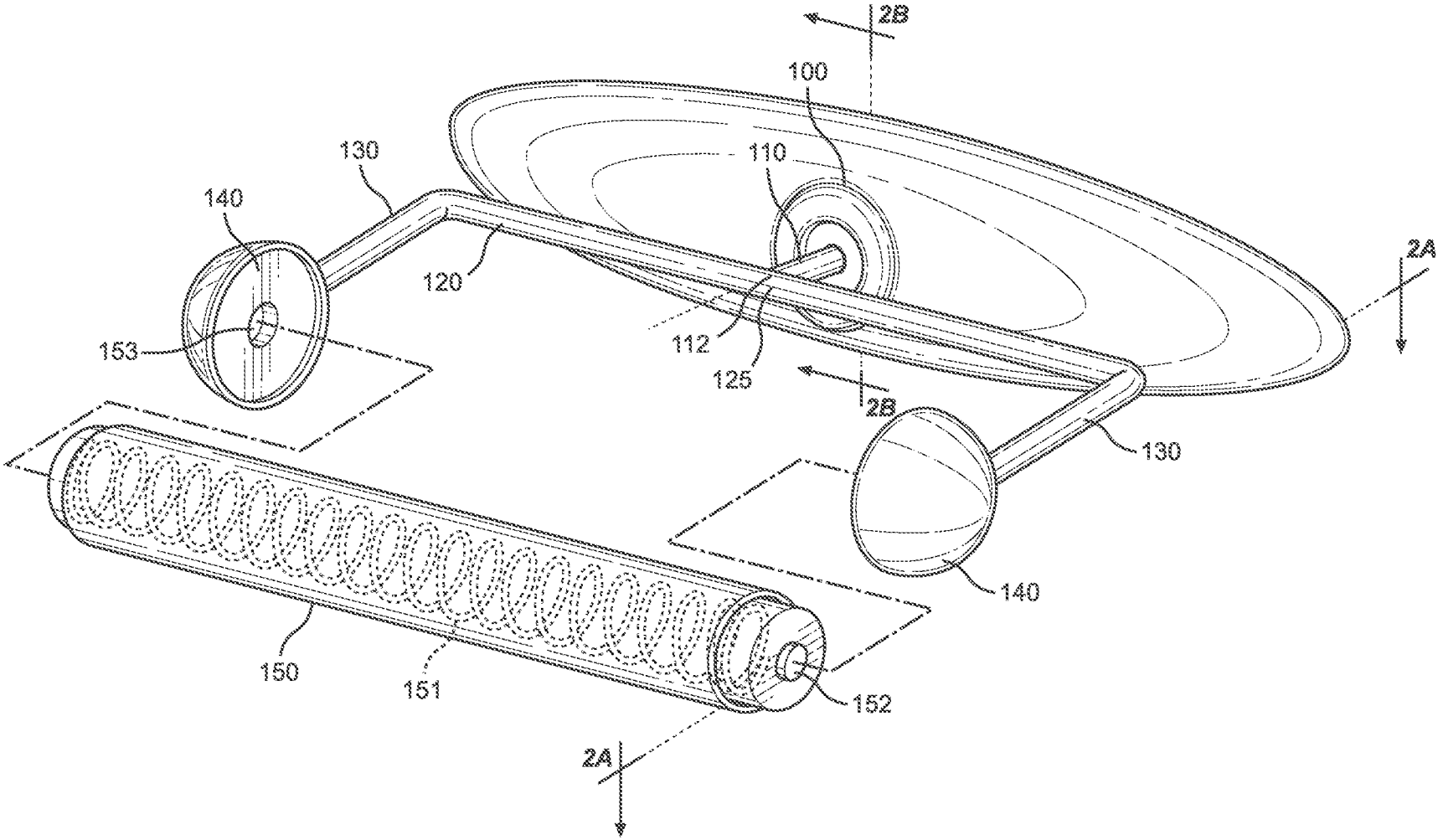
FIG. 1 shows an exploded view of an embodiment of the reversible toilet paper roll holder.

Reference is made herein to the attached drawings. Like reference numerals are used throughout the drawings to depict like or similar elements of the reversible toilet paper roll holder. For the purposes of presenting a brief and clear description of the present invention, a preferred embodiment will be discussed as used for the reversible toilet paper roll holder. The figures are intended for representative purposes only and should not be considered to be limiting in any respect.

Referring now to FIG. 1, there is shown an exploded view of an embodiment of the reversible toilet paper roll holder. The reversible toilet paper roll holder comprises a base 100 with an arm 110 extending outwardly through the base 100. In the shown embodiment, the arm 110 is disposed perpendicular to the base to form a ninety-degree angle. In the preferred embodiment, the base 100 has a planar back surface such that the base 100 can rest flush against a desired surface such as a bathroom wall. In other embodiments, the back surface of the base 100 includes contours that mimic the peaks and valleys associated with tiles and grout. In this manner, the base 100 can fill the valleys and securely fit over a tiled wall without leaving any gaps. In one embodiment, the base 100 is secured to the desired surface via fasteners such as nails, screws, or the like. In an alternate embodiment, the base 100 is secured to the desired surface via an adhesive. In a further embodiment, the adhesive is a peel and stick adhesive that will not damage the desired surface when the base 100 is removed therefrom.

A horizontal support 120 is connected to a second end 112 of the arm 110. In the shown embodiment, the horizontal support 120 is perpendicular to the arm 110. Further, in the shown embodiment, the horizontal support 120 is connected to the second end 112 of the arm 110 at a midpoint 125 along the horizontal support 120. An object of the current invention is to secure and rotate a toilet paper roll within the reversible toilet paper roll holder via rotation of the arm 110. By securing the arm 110 at a midpoint 125 of the horizontal support 120, balance is maintained when the horizontal support 120 is rotated, as further detailed below. In such a manner, the horizontal support 120 utilizes the same horizontal space throughout the rotation thereof. The consistency of horizontal space utilized can be important in close quarters where space is at a premium.

A pair of lateral supports 130 are connected to the horizontal support 120. In the shown embodiment, the pair of lateral supports 130 are connected at opposing distal ends of the horizontal support. Additionally, in the shown embodiment, the pair of lateral supports 130 are disposed parallel to each other. In further embodiments, the pair of lateral supports 130 and the horizontal support 120 comprise a U-shaped configuration. In the shown embodiment, each of the pair of lateral supports 130 further comprise a receptacle 140 disposed on a terminal end thereof. The pair of receptacles 140 are configured to secure a compressible rod 150 therebetween. Such a U-shaped configuration enables the compressible rod 150 to be secured while leaving room for a roll of toilet paper to freely spin while secured to the reversible toilet paper roll holder.

In the shown embodiment, an internal spring 151 enables the compressible rod 150 to move between a compressed and an expanded configuration and the compressible rod 150 is biased towards the expanded configuration. The compressible rod 150 is sized, shaped, and configured to pass through a central bore of a toilet paper roll (as shown in FIG. 2). A length of the compressible rod 150 is less than a length of the horizontal support 120 when the compressible rod 150 is in a compressed position. In some embodiments, the length of the compressible rod 150 is greater than the length of the horizontal support 120 when the compressible rod 150 is in an expanded configuration. In this manner, a user can pass the compressible rod 150 through the central bore of the toilet paper roll and compress the compressible rod 150 in order to orient the compressible rod 150 into a position in which the compressible rod 150 can be received by the pair of receptacles 140.

In the shown embodiment, each of a pair of opposing ends of the compressible rod 150 include a protrusion 152. In such an embodiment, each of the receptacles 140 further comprise a recession 153. In a further embodiment, each recession 153 is configured to receive a protrusion 152 of the compressible rod 150. When the protrusions 152 and the recessions 153 are aligned, the compressible rod 150 can be allowed to expand and engage the pair of receptacles 140 in order to secure the roll of toilet paper within the reversible toilet paper holder. In this manner, the compressible rod 150 can be locked and secured to the pair of lateral supports 130. The procedure can be reversed when adding, removing, or replacing a roll of toilet paper. In other embodiments, the receptacles 140 or the lateral supports 130 can be configured to secure a toilet paper roll therebetween. For example, the receptacles 140 can have a protrusion sized to receive the central bore of the toilet paper roll, or the lateral supports 130 can be positioned to engage the toilet paper roll by friction fit. In the shown embodiment, a perimeter lip is disposed around the receptacles that corresponds to a diameter of the compressible rod 150 such that the compressible rod 150 is received by the perimeter lip in close tolerance.

Figure 2A:
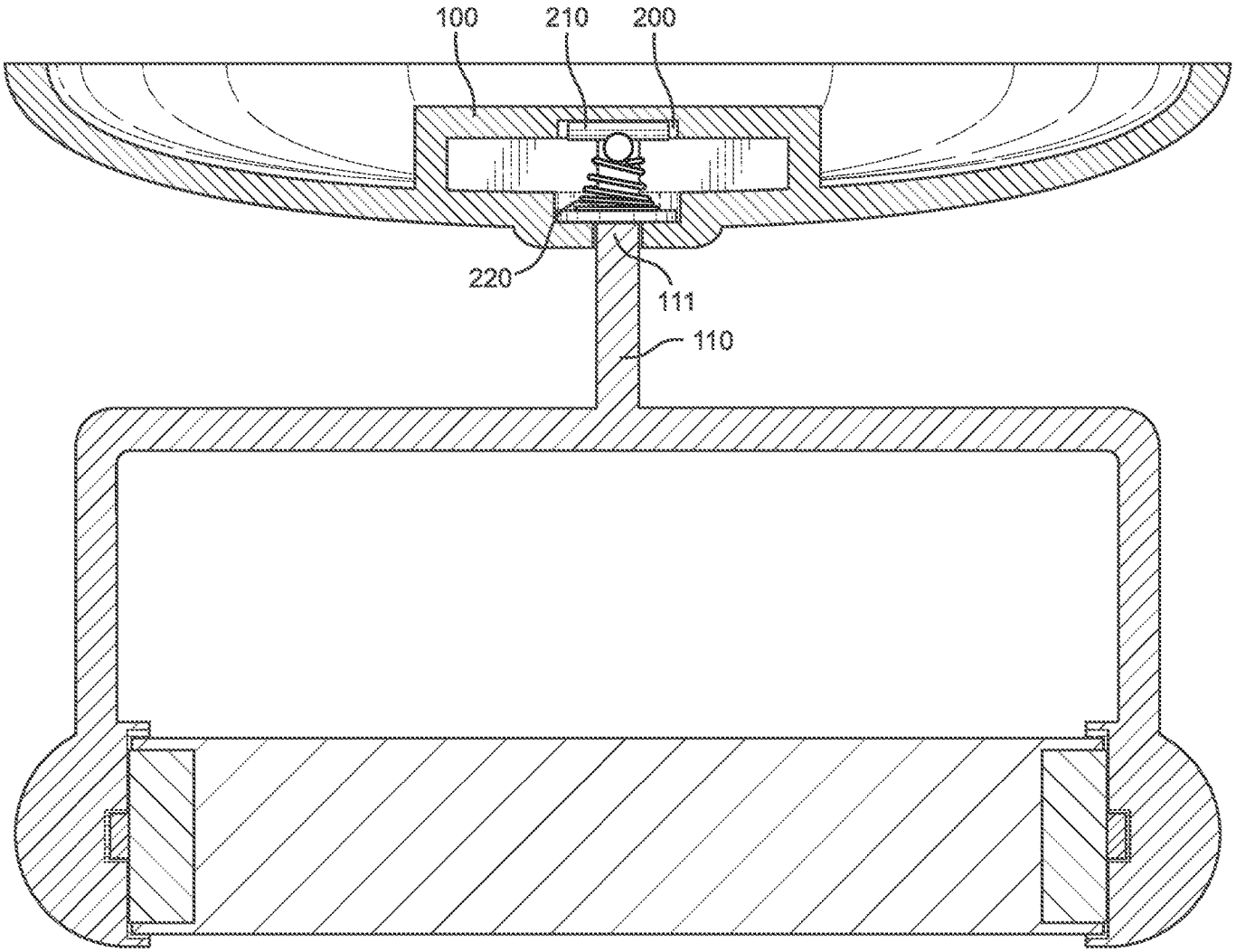
FIG. 2A shows a top-down cross-sectional view of an embodiment of the reversible toilet paper roll holder in a locked configuration.

Referring now to FIG. 2A, there is shown a top-down cross-sectional view of an embodiment of the reversible toilet paper roll holder in a locked configuration. A first end 111 of the arm 110 is rotatably secured to a locking notch 200. In the shown embodiment, the locking notch 200 is disposed in the base 100. In the shown embodiment, the locking notch 200 is a planar cut-out in the base 100 that is sized to receive a planar locking pin 210. The locking pin 210 is secured to the first end 111 of the arm 110 via a locking spring 220. The locking spring 220 is biased towards an expanded position, and when the locking spring 220 is expanded, the arm 110 is thus spring biased towards a working position. The locking notch 200 is sized and shaped to receive the planar locking pin 210. In the shown embodiment, the locking pin 210 and the horizontal support are coplanar such that a user is able to orient themselves to the position of the locking pin 210 without directly viewing the locking pin 210 and instead observing the orientation of the horizontal support as the arm 110 is rotated.

Figure 2B:
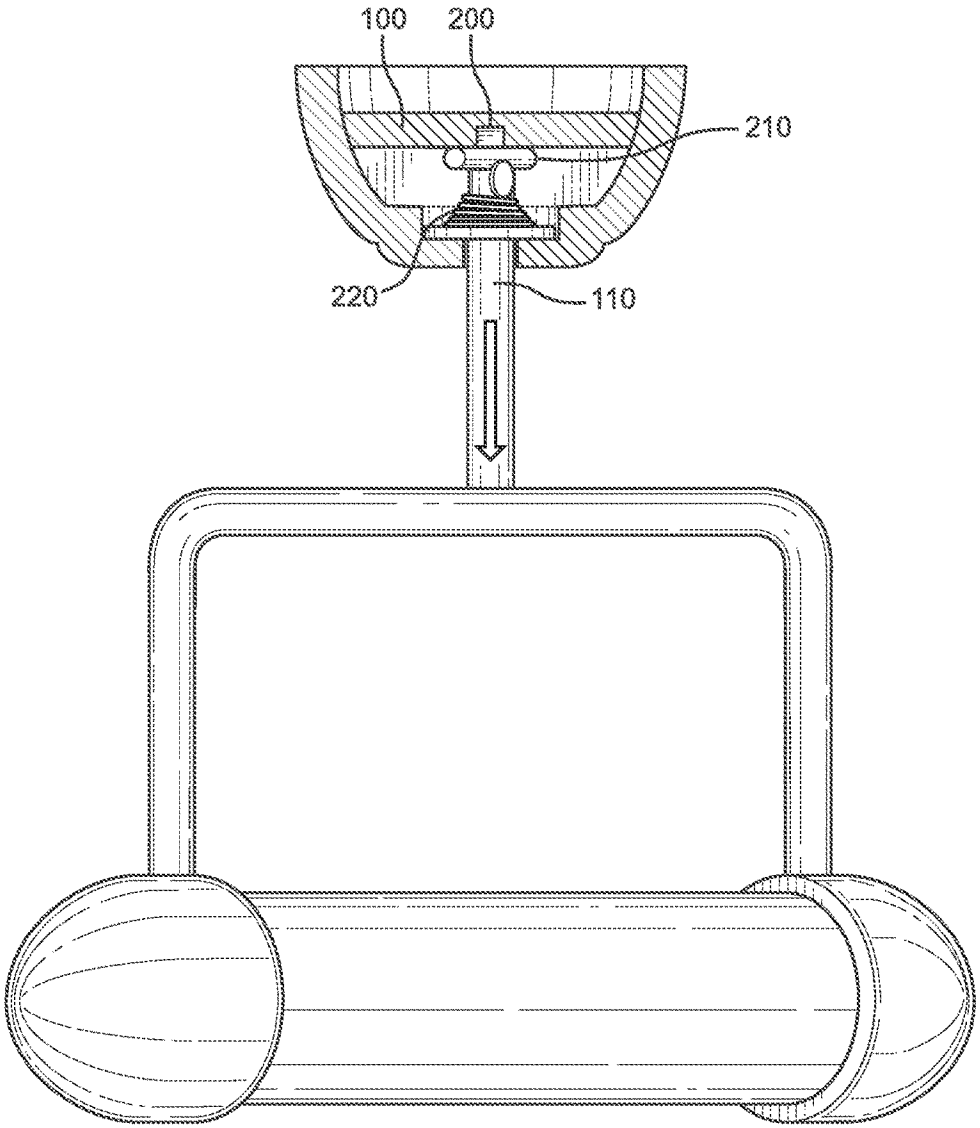
FIG. 2B shows a side cross-sectional view of an embodiment of the reversible toilet paper roll holder in a transitory configuration.

Referring now to FIG. 2B, there is shown a side cross-sectional view of an embodiment of the reversible toilet paper roll holder in a transitory configuration. In the shown embodiment, the planar locking pin 210 is oriented at an angle such that it is not received by the locking notch 200. As both the locking pin 210 and the locking notch 200 are planar, when the arm 110, and therefore the locking pin 210, is rotated, the locking pin 210 does not line up with the locking notch 200. The arm 110 is spring biased towards a working position wherein the locking spring 220 is expanded. The arm 110 can be pulled in a direction away from the base 100, as shown, in order to compress the locking spring 220 and pull the locking pin 210 out of the locking notch 200. In such a manner, when the locking pin 210 is out of the locking notch 200, the arm 110 is free to rotate. When the arm 110 is rotated one-hundred eighty degrees, or three-hundred and sixty degrees, the locking pin 210 is aligned with the locking notch 200, such that the locking spring 220 can be allowed to return to its expanded position and thereby lock the arm 110 in a given orientation.

Figure 3:
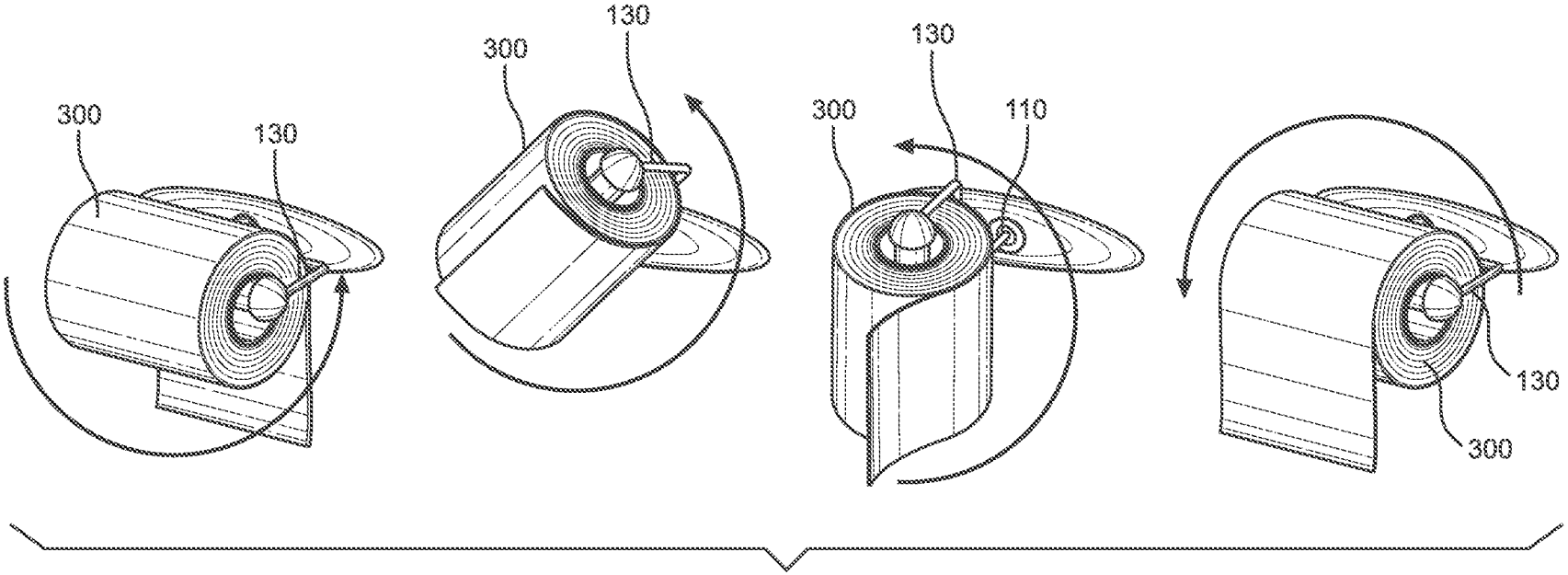
FIG. 3 shows a series of perspective views of an embodiment of the reversible toilet paper roll holder, demonstrating the use thereof.

Referring now to FIG. 3, there is shown a series of perspective views of an embodiment of the reversible toilet paper roll holder, demonstrating the use thereof. In the shown series of perspective views, a user is able to rotate the toilet paper roll 300 about an axis defined by the arm 110, from a behind-the-back configuration where the sheets of toilet paper from the toilet paper roll 300 are distributed from behind the roll of paper to an over-the-top configuration where the sheets of toilet paper from the toilet paper roll 300 are distributed over the top of the roll and from the front of the roll. By manipulating the arm 110, and thereby the plurality of lateral supports 130 which support the toilet paper roll 300, the orientation of the toilet paper roll 300 can be adjusted to the orientation desired by the user without removing the toilet paper roll 300 from the reversible toilet paper roll holder. The locking pin, in conjunction with the locking notch enables the toilet paper roll 300 to be held, secured, and locked in one of a pair of dispensing positions; the over-the-top configuration or the behind-the-back configuration. In such a manner, each individual user can orient the toilet paper roll 300 to their preferential orientation, without removing the roll.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reversible toilet paper roll holder, comprising:

a base with an arm extending perpendicularly from a front side of the base;

wherein a first end of the arm is disposed within the base and is rotatably secured to a locking notch such that the arm selectively rotates about a longitudinal axis thereof;

a horizontal support perpendicularly connected to a second end of the arm;

a pair of lateral supports perpendicularly connected to opposing ends of the horizontal support; and wherein the pair of lateral supports are configured to secure a toilet paper roll.

2. The reversible toilet paper roll holder of claim 1, wherein the pair of lateral supports are disposed parallel to each other.

3. The reversible toilet paper roll holder of claim 1, wherein the pair of lateral supports and the horizontal support comprise a U-shaped configuration.

4. The reversible toilet paper roll holder of claim 1, wherein the arm is spring biased toward a working position.

5. The reversible toilet paper roll holder of claim 1, wherein a back surface of the base is planar.

6. The reversible toilet paper roll holder of claim 1, wherein the locking notch is disposed within an isolated chamber disposed in the base.

7. The reversible toilet paper roll holder of claim 1, wherein the horizontal support is connected to the second end of the arm at a midpoint along the horizontal support.

8. A reversible toilet paper roll holder, comprising:

a base including a planar back surface;

an arm extending perpendicularly from a front side of the base;

wherein a first end of the arm is disposed within the base and is rotatably secured to a locking notch such that the arm selectively rotates about a longitudinal axis thereof;

a horizontal support perpendicularly connected to a second end of the arm;

a pair of lateral supports perpendicularly connected to opposing ends of the horizontal support;

each of the pair of lateral supports further comprising a receptacle disposed on a terminal end thereof;

wherein each receptacle is configured to secure a compressible rod therebetween; and the compressible rod configured to pass through a central bore of a toilet paper roll.

9. The reversible toilet paper roll holder of claim 8, wherein the pair of lateral supports are disposed parallel to each other.

10. The reversible toilet paper roll holder of claim 8, wherein the pair of lateral supports and the horizontal support comprise a U-shaped configuration.

11. The reversible toilet paper roll holder of claim 8, wherein the arm is spring biased toward a working position.

12. The reversible toilet paper roll holder of claim 8, wherein opposing ends of the compressible rod include a protrusion.

13. The reversible toilet paper roll holder of claim 12, wherein each of the receptacles further comprise a recession.

14. The reversible toilet paper roll holder of claim 13, wherein each recession is configured to receive the protrusion of the compressible rod.

15. The reversible toilet paper roll holder of claim 8, wherein the locking notch is disposed within an isolated chamber disposed in the base.

16. The reversible toilet paper roll holder of claim 8, wherein the horizontal support is connected to the second end of the arm at a midpoint along the horizontal support.

17. The reversible toilet paper roll holder of claim 8, further comprising a lip disposed about a perimeter of each receptacle, wherein the lip is dimensioned to retain the compressible rod therein.

18. The reversible toilet paper roll holder of claim 1, further comprising a locking pin affixed perpendicularly to the first end of the arm, wherein the locking pin is dimensioned to secure within the locking notch when the arm is in a working position.

19. The reversible toilet paper roll holder of claim 18, wherein the locking pin prevents rotation of the arm about the longitudinal axis when the arm is in the working position.

20. The reversible toilet paper roll holder of claim 8, further comprising a locking pin affixed perpendicularly to the first end of the arm, wherein the locking pin is dimensioned to secure within the locking notch when the arm is in a working position.

* * * * *